United States Patent [19]

Narayan

[11] Patent Number: 5,046,291

[45] Date of Patent: Sep. 10, 1991

[54] FLOOR PANEL ASSEMBLY

[75] Inventor: Badri Narayan, Ann Arbor, Mich.

[73] Assignee: Unistrut Corporation, Ann Arbor, Mich.

[21] Appl. No.: 534,396

[22] Filed: Jun. 7, 1990

[51] Int. Cl.[5] ..... E04B 5/43

[52] U.S. Cl. ..... 52/126.6; 52/263; 52/792

[58] Field of Search ..... 52/126.6, 126.5, 263, 52/792, 716

[56] References Cited

U.S. PATENT DOCUMENTS

| | | | |
|---|---|---|---|
| 3,196,763 | 7/1965 | Rushton | 52/792 |
| 4,142,341 | 3/1979 | Mott | 52/263 |
| 4,411,121 | 10/1983 | Blacklin et al. | 52/792 |
| 4,447,998 | 5/1984 | Griffin | 52/263 |
| 4,753,058 | 6/1988 | Ray | 52/792 |

FOREIGN PATENT DOCUMENTS

| | | | |
|---|---|---|---|
| 124978 | 10/1960 | France | 52/792 |

*Primary Examiner*—Richard E. Chilcot, Jr.
*Assistant Examiner*—Joanne C. Downs
*Attorney, Agent, or Firm*—Dykema Gossett

[57] ABSTRACT

A floor panel used in raised flooring systems is constructed to support an impinging load. The panel is supported at its corners and has a substantially flat upper surface and a lower surface comprised of hemispherical domes. The poles of the domes directly contact and support the upper panel. The domes are preferably flattened in the general vicinity of the poles to provide superior support to the upper panel. An arcuate trim members surrounds the panel and facilitates the assembly of the panel. The trim member creates a separating gap between panels, thereby facilitating their removal and replacement and creates a seal to prevent debris from entering between adjacent panels.

11 Claims, 3 Drawing Sheets

FLOOR PANEL ASSEMBLY

BACKGROUND OF THE INVENTION

The present invention relates generally to structural floor panels and more specifically relates to panels which are used in raised floor applications.

Raised floor systems are typically used in installations where wire cables, pipes or the like must be concealed and easily accessible. The most common application or raised floor systems is in conjunction with computer rooms. Typically, a computer room houses a plurality of computers and associated peripheral devices. These devices typically include a large number of electrical cables which must run from device to device and from device to equipment not located within the bounds of the computer room. Raised flooring systems offer a way of concealing the large number of cables while still allowing the cables to be accessed for servicing and other purposes.

Raised flooring systems essentially are comprised of a first floor which is constructed above and supported by a second floor. The first floor usually consists of a plurality of structural panel elements which are supported above the second floor by a plurality of stilt or pedestal members. These pedestal members are typically located at the corners of the panel members. Because the panel members must serve as structural support members capable of bearing the load imposed on them, their design goes beyond sheer aesthetics generally associated with tiling, and their structural integrity becomes a predominant concern.

Many floor panel designs have been disclosed for creating raised floor systems. For example, U.S. Pat. No. 4,594,833 issued to Mieyal on June 17, 1986 discloses a floor panel constructed from a honeycomb structure. Although designs of this type may be effective, they consist of many individual parts which must be assembled, thereby adding to the expense of producing this honeycomb structure.

Other raised floor designs incorporate the use of concrete as a core element. For example, U.S. Pat No. 4,067,156 issued to Downing, Jr. on Jan. 10, 1978 discloses a panel for elevated access floors in which the panel is formed of reinforced expanded lightweight concrete. Although floor panels which are constructed of concrete exhibit superior load-bearing characteristics, they are generally more expensive to produce than floor panels constructed of sheet metal and other lightweight materials, and their load-bearing capacity greatly exceeds that which is normally needed in conventional computer room installations. Their concrete core construction also has the drawbacks of being extremely heavy and difficult to maneuver.

Other panel constructions utilize the combination of concrete and sheet metal, such as U.S. Pat. No. 4,621,468 issued to Likozar on Nov. 11, 1986. This patent discloses an access floor panel which is comprised of a sheet metal pan filled with lightweight concrete material. This type of flooring system shares similar advantages and disadvantages with those of the '156 patent issued to Downing, Jr. previously discussed.

U.S. Pat. No. 4,426,824 issued to Swensen on Jan. 24, 1984 discloses an elevated floor panel formed of an upper sheet metal surface member and a lower sheet metal support member. Panels incorporating sheet metal as their primary structural component offer some advantages over the previously discussed panel designs.

For example, the weight of a sheet metal panel is typically a fraction of its concrete counterpart. In addition, they are typically much cheaper to manufacture and easier to maneuver. The '824 patent issued to Swensen uses a system of integral legs formed of material which is displaced from the lower support member. These legs are formed upwardly and fastened to the upper surface member. Because each aperture includes a plurality of integral legs, each leg within each aperture must be independently welded or otherwise fastened to the upper support surface member. Each weld which must be made adds to the total cost of each panel. Additionally, since each leg stands alone, it gains no lateral support from adjacent legs in close proximity to the weld. This limits the overall strength which can be achieved in panels using this type of design.

Although the primary purpose of raised floor panels is to structurally support an applied load, they must also be easily removable and insertable. This feature is necessary because the plurality of wire and cables they conceal must often be accessed for servicing or the like. Ideally, the panels abut one another along their peripheral faces, thereby preventing any substantial lateral movement of the flooring system. Typically, however, the individual panels become wedged against each other. This wedging can be caused by slight lateral movement of the panels or may be caused by debris which is driven between adjacent panels. When two panels become wedged, they are very difficult to remove.

It is therefore a principal object of this invention to provide a raised floor panel which is of lightweight construction having superior load-bearing capacity.

Another object of the present invention is to provide a raised floor panel which is easily removed and installed.

Still another object of the present invention is to provide a raised floor panel which is inexpensive to manufacture, durable and simple in construction.

SUMMARY OF THE INVENTION

In light of the foregoing objects, the present invention provides a floor panel for use in supporting loads, comprising: a first, substantially flat, rectangular panel, a second panel having a plurality of generally hemispherical depressions formed therein, each depression having a pole in contact with the first rectangular panel, each pole adapted to transfer the load from said first panel to the second panel.

In a preferred embodiment, the generally hemispherical depressions are generally flat in the vicinity of their poles, and the generally hemispherical depressions are fastened to the first plate at their poles. The second panel preferably includes integral vertical side walls about its periphery, the side walls rising vertically upward and terminating in an outwardly flanged end, the flanged end adapted to contact and support the first panel about the periphery of the first panel. The panel also preferably includes a trim member, the trim member having a beveled corner along the length of an outward edge, the trim member adapted to fasten to the periphery of the floor panel, the beveled corner adapted to extend beyond the periphery of the first and second panels, thereby contacting at the extremity of its beveled extension the beveled corner of a neighboring panel, the beveled corner keeping neighboring panels slightly separated, thereby facilitating their removal and installation.

The panel preferably includes a plurality of holes spaced about its periphery, and the trim member is preferably constructed from resilient material and has an arched body and a plurality of staking projections integral to and extending from its arched body, each projection adapted to be received within a respective panel hole upon the deforming of the arched body, whereby each staking projection is received within its respective panel hole, the resilient body urging the staking projections against the side walls of said panel holes wherein the urging keeps the trim member in place during the manufacture of said panel.

These, together with other objects and advantages which will become subsequently apparent, reside in the details of construction and operation as more fully hereinafter are described and claimed.

DESCRIPTION OF THE PREFERRED EMBODIMENTS

Figure 1:
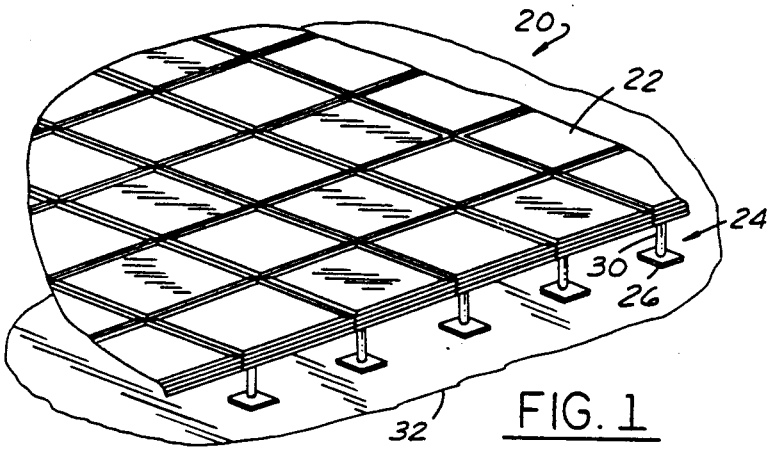
FIG. 1 is an isometeric view of a raised flooring system.

Referring now to the drawings, FIG. 1 shows the raised flooring system 20 of the present invention, including a plurality of floor panels 22 and a plurality of pedestals 24. The pedestals 24 are composed of a lower base 26 and an upper base 28 (upper base not shown). Separating the lower base 26 from the upper base 28 is a main support member 30. Main support member is welded or otherwise fastened to the lower and upper base 26, 28 and provides a means for supporting floor panel 22 at its corners. Upper base (not shown) o each pedestal 24 is adapted to support the corners of four adjacent panels. The use of pedestals 24 in conjunction with floor panels 22 allows the construction of an elevated floor whereby cables, service ducts and the like can be routed underneath the raised floor. Raised flooring systems are commonly used in computer rooms and other facilities where a large number of service cables or ducts must be separated from human traffic while remaining easily accessible. The pedestals 24 rest upon subfloor 32. The spacing of pedestals 24 corresponds to the nominal side dimensions of panels 22.

Figure 2:
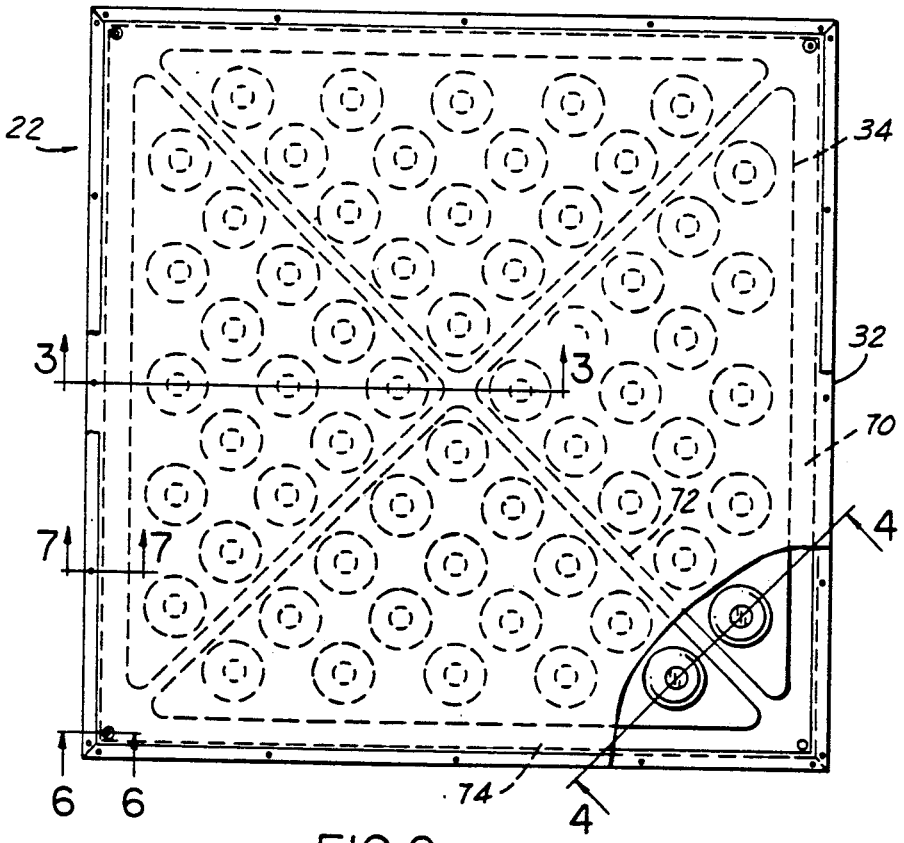
FIG. 2 is a plan view of a single flooring tile used in the raised flooring system of FIG.1.

Now referring to the drawing of FIG. 2, floor panel 22 consists of an upper, substantially flat rectangular panel 32 and a lower panel 34. Upper and lower panels 32, 34 are preferably constructed from sheet metal and more preferably from cold-rolled carbon steel per ASTM specification A620-84. The floor panel 22 is preferably rectangular and ideally square; however, any polygonal configuration could be used as long as it would not tend to rock when supported by pedestals 24. It is important to note that although in the preferred construction panel 22 is comprised of sheet metal, other materials such as high-density foam, plastic, Fiberglas TM or the like could be used to construct the disclosed floor panel 22.

Figure 3:
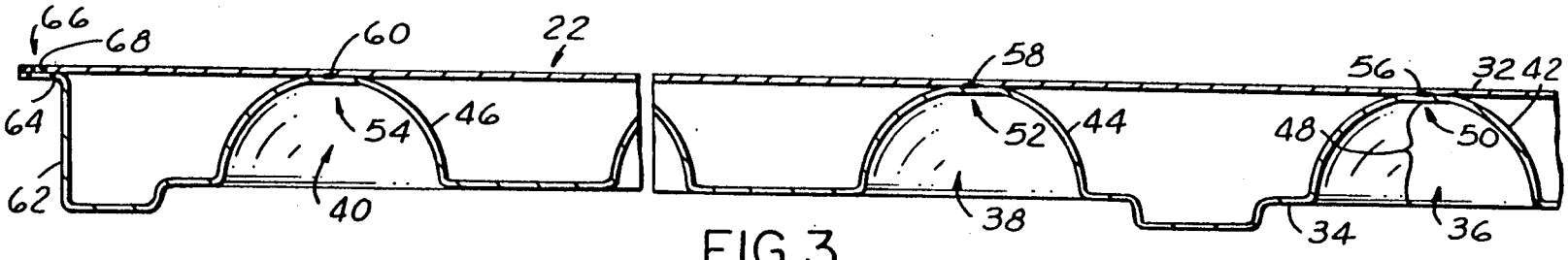
FIG. 3 is a partial cross-sectional view taken substantially along line 3—3 of FIG. 2.

Now referring to the drawing of FIG. 3, upper panel 32 is supported by a plurality of raised surfaces 36–40. Raised surfaces 36–40 are preferably formed by stamping hemispherical domes 42–46 in lower panel 34. Hemispherical domes 42–46 are substantially the same height, thereby providing a uniformly flat contact surface for upper panel 32. Each respective dome 42–46 has an uppermost portion (or pole) 50–54 which is in direct contact with and fastened to upper panel 32. Dome poles 50–54 may be fastened to upper panel 32 by any number of means; however, spot welding in accordance with AWS C1.1-66, "Recommended Protectives for Resistance Welding," is the preferred method. In using a plurality of hemispherical domes 50–54 to support upper panel 32, a number of objectives are achieved. First, only one weld 56–60 is required to join each dome 42–46 to the upper panel 32. This single weld construction is made possible by virtue of the structural superiority of the spherical dome design. Other types of designs have been used (such as a plurality of support fingers), but these designs require a plurality of spot welds for each group of fingers. Additionally, each support finger gains no support from adjacent fingers and must rely on the integrity of its own construction; however, the dome design of the present invention presents a unified structure wherein the raised surface of each dome is contiguous, thereby yielding superior load-bearing characteristics.

Lower panel 34 also includes a substantially vertical wall 62. Vertical wall 62 encircles the perimeter of lower panel 34 and terminates in an outwardly flanged end 64. Vertical wall 62 is preferably integral to lower panel 34. Vertical wall 62 and flange 64 act to support upper panel 32 along its periphery 66. A plurality of holes 68 are placed in flange 64 and upper panel 32. Holes 68 provide a means of fastening a trim member to panel 22. This facet of the present invention will be described more completely in conjunction with FIGS. 7–12.

Figure 4:
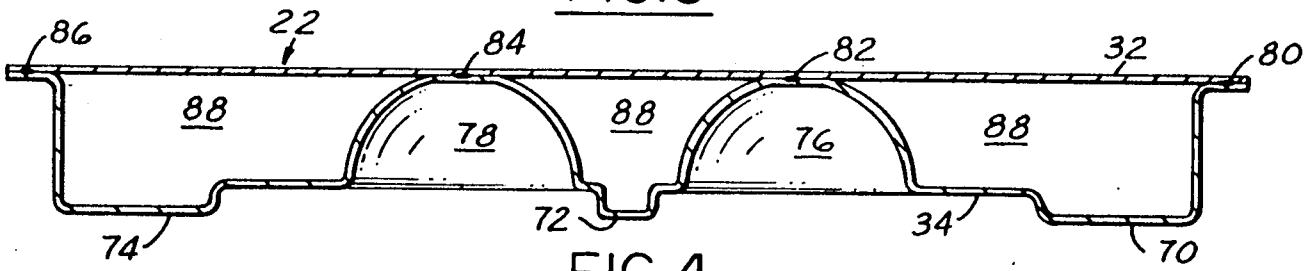
FIG. 4 is a partial cross-sectional view taken substantially along line 4—4 of FIG. 2.

Now referring to the drawings of FIGS. 1 and 4, lower panel 34 is comprised of a series of strengthening ridges (or channels) 70–74. Ridges 70–74 give panel 22 a resistance to warping or buckling caused by twisting forces. Ridges 70–74 preferably have a U-shaped cross-section and are formed in lower panel 34 between spaced apart domes 76, 78. It can be seen that the combination of hemispherical domes 76, 78, along with the interspersing of strengthening ridges 70–74 and spot welds 80–86, create a unified panel structure exhibiting superior load-bearing characteristics. Materials 88, which can be placed between upper panel 32 and lower panel 34 to improve the overall load-bearing characteristics of panel 22, include foam, plastic, rubber, cement and the like. Of course, the maximum load-bearing capacity for any given panel design depends upon the thickness of sheet metal selected, material 88 residing between upper panel 32 and lower panel 34, and other factors known to those skilled in the art.

Figure 5:
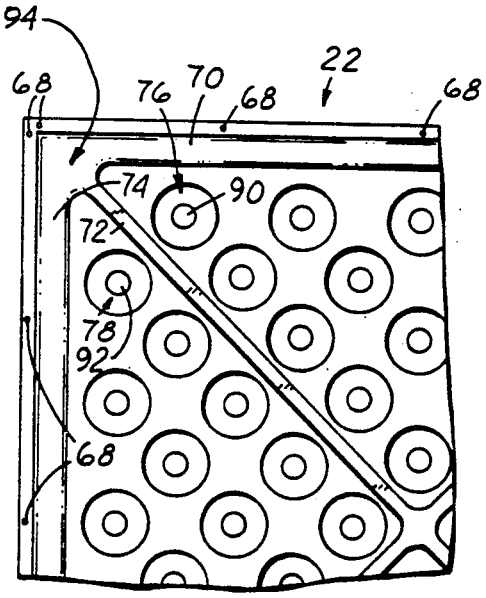
FIG. 5 is a partial bottom view of the floor panel of FIG. 2.

Now referring to the drawing of FIG. 5, panel 22 (when viewed from the bottom) exhibits hemispherical domes 76, 78 and strengthening ridges 70–74. Hemispherical domes 76, 78 are preferably flattened around the vicinity of their poles (flattened area shown at reference numerals 90, 92). Flattened poles 90, 92 act to support upper panel 32 in the vicinity of the hemispherical poles and accordingly establish a proper contact surface for spot welding. Upper base 28 (not shown) of pedestal 24 is adapted to support panel 22 from its corner area 94 and preferably from the area where strengthening ridges 70–74 run together.

Figure 6:
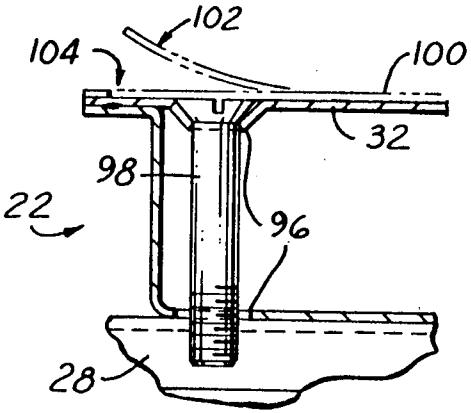
FIG. 6 is a partial cross-sectional view taken substantially along line 6—6 of FIG. 2.

Now referring to the drawing of FIG. 6, in the vast majority of installations, panel 22 will rest upon upper base 28 without the use of a fastener. Although this is the most common way of erecting a raised floor system, the panel of the present invention does have hole 96 at each one of its corners. Hole 96 is adapted to accept fastener 98, such as a bolt or the like, for securely fastening panel 22 to base 28. Upper panel 32 is typically covered with tile 100. Tile 100 could be made from vinyl, asphalt, carpeting or the like. The major consideration in choosing tile 100 is that if a fastener 98 is employed in the raised floor system, tile 100 must be able to accommodate lifting 102 and replacing 104 in order to provide access to fastener 98.

Figure 7:
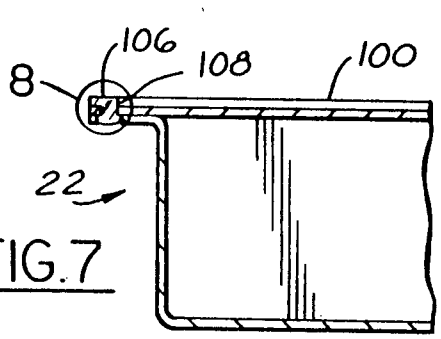
FIG. 7 a partial cross-sectional view taken substantially along line 7—7 of FIG. 2.

Now referring to the drawing of FIG. 7, panel 22 preferably includes trim member 106. Trim member 106 eliminates the shoulder or step 108 which would otherwise be present along the perimeter of tile 100. Trim member 106 also provides a means for keeping adjacent panels separated in order to accommodate their removal and replacement. This feature of the present invention will be explained in greater detail in conjunction with FIGS. 8–12.

Figure 8:
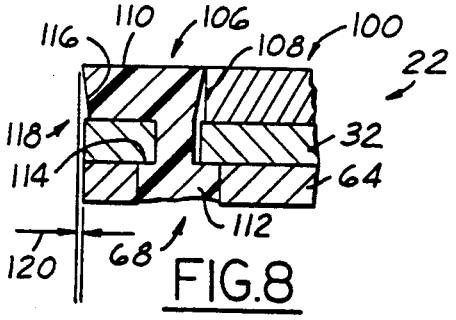
FIG. 8 is a detailed drawing of the flange encircled by line 8 of FIG. 7.

Now referring to the drawing of FIG. 8, hole 68 runs through outwardly flanged end 64 and upper panel 32. Trim member 106 has an upper horizontal portion 110 which terminates into a staking projection 112. Hole 68 is preferably narrowed as it progresses from flanged end 64 into and through upper panel 32. This narrowing creates a shoulder 114 for securing staking projection 112 within hole 68. Trim member 106 is preferably constructed from plastic or the like and is preferably fastened into hole 68 by way of compressing staking projection 112 within hole 68. Compressing staking projection 112 can be done with the aid of heat.

Fastener horizontal portion 110 should be closely matched in height to that of tile 100. This will prevent tile shoulder 108 from premature wear caused by traffic. It also prevents the likelihood that shoulder 108 would cause tripping.

Fastener horizontal portion 110 has a beveled corner 116 along the length of outward edge 118. This beveled corner 116 extends beyond the edge of upper panel 32 and the outwardly flanged end 64 of lower panel 34. This extension is shown at reference numeral 120. The purpose of extending trim member 106 beyond the peripheral edge of panel 22 is to facilitate the removal and installation of panel 22. This feature will be explained in detail in conjunction with FIG. 12.

Figure 9:
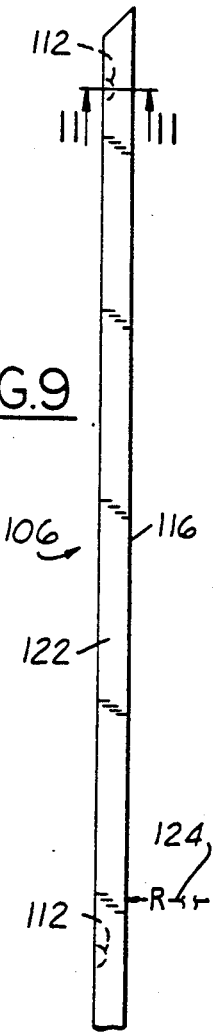
FIG. 9 plan view of the trim member of the present invention.

Now referring to the drawing of FIG. 9, trim member 106 preferably has a plurality of staking projections 112 formed integral to trim member body 122. Trim member body 122 is preferably slightly arcuate 124. This slight arc causes trim body 122 to be slightly bowed. This slight bowing is preferable in order to keep staking projections 112 of trim member 106 within holes 68 during the manufacturing process. By designing a slight arc 124 into trim member body 122, trim member 122 must be deformed in order for each staking projection 112 to be received in its respective panel hole 68. Once each staking projection 112 is received within its respective hole 68 and released from its deforming force, the natural resilience of body member 122 will cause the staking projections to urge against the sides of their respective hole 68, thereby causing trim member 106 to be retained on panel 22 until the staking projections 112 can be heat-staked or otherwise permanently fastened onto panel 22.

Figure 10:
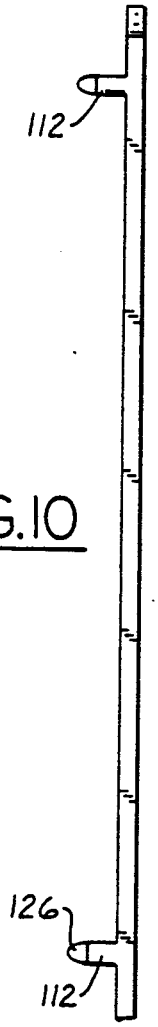
FIG. 10 a partial front view of the trim member of FIG. 9.

Now referring to the drawing of FIG. 10, staking Projections 112 preferably have an end 126 having a pointed or conical shape. This features facilitates aligning and driving staking projection 112 into its respective hole 68.

Figure 11:
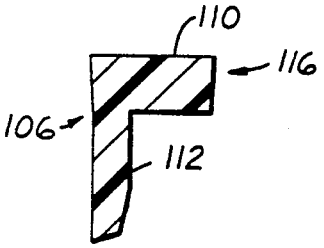
FIG. 11 is a cross-sectional view taken substantially along line 11—11 of FIG. 9.

Now referring to the drawing of FIG. 11, trim member 106 is comprised of a horizontal portion 110 and a vertical staking projection 112. Fastener horizontal portion 110 has a beveled corner 116 along its outward edge. The purpose of this beveled corner will now be explained in conjunction with FIG. 12.

Figure 12:
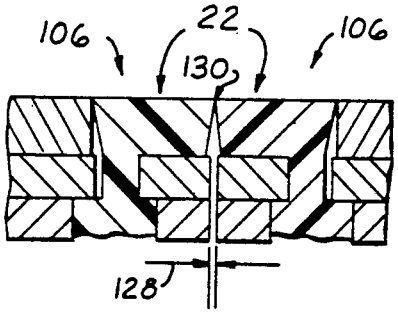
FIG. 12 is a partial cross-sectional view of two adjoining floor panels of the present invention.

Now referring to the drawing of FIG. 12, upon assembling a plurality of floor panels into a raised flooring system as shown in FIG. 1, a cross-section through any two adjacent floor panels results in the relative panel position shown in FIG. 12. Extension 120 (as depicted in FIG. 8) results in providing a gap 128 between adjacent panels. By maintaining gap 128, panels 122 can be easily removed from the flooring system should the need ever occur. If gap 128 is not provided, adjoining floor panels create binding forces against one another which tend to make removal of a given floor panel very difficult. The design of trim member 106 provides another useful feature in that the contact established at point 130 creates a seal across gap 128, thereby preventing debris from entering into and bridging across gap 128. If debris is allowed to enter into gap 128, the gap becomes bridged, and similar problems arise to those experienced in floor systems where no gap is provided.

The foregoing detailed description shows that the preferred embodiments of the present invention are well-suited to fulfill the objects of the invention. It is recognized that those skilled in the art may make various modifications or additions to the preferred embodiments chosen here to illustrate the present invention, without departing from the spirit of the present invention. For example, panel 22, although depicted as generally rectangular, could be easily fashioned from any number of polygonal shapes. It is also contemplated that the panel disclosed in the present invention is not limited to raised flooring systems using pedestals 24 as their means of elevating panels 22, but is equally applicable to raised flooring systems using channels or beams which run along the outside perimeter of the panel 22. Accordingly, it is to be understood that the protection sought to be afforded hereby should be deemed to extend to the subject matter defined in the appended claims, including all fair equivalents thereof.

I claim:

1. A floor panel for use in supporting loads, comprising:

a first, substantially flat, rectangular panel;

a second panel having a plurality of generally hemispherical domes formed therein, each said dome having a pole in contact with said first rectangular panel, each said pole adapted to transfer said load from said first panel to said second panel; and wherein said panel has a plurality of holes spaced about its periphery and wherein said panel further includes a resilient trim member having an arched longitudinal body and a plurality of staking projections integral to and extending from said arched body, each projection adapted to be received within a respective panel hole upon the deforming of said arched body, whereby upon placing of each staking projection in its respective panel hole releasing of a deforming force upon said arched body, said body urges said staking projections against the side walls of said panel holes whereby said urging keeps said trim member in place during the manufacture of said panel.

2. The floor panel for use in supporting loads recited in claim 1 wherein each generally hemispherical dome is fastened to said first panel.

3. The floor panel for use in supporting loads recited in claim 2 wherein each generally hemispherical dome is fastened to said first panel at its pole.

4. The floor panel for use in supporting loads recited in claim 3 wherein said generally hemispherical domes are spaced apart along said second panel and said second panel includes strengthening ridges residing in said spaces between said hemispherical domes.

5. The floor panel for use in supporting loads recited in claim 1 wherein each said generally hemispherical dome is generally flat in the vicinity of said pole.

6. The floor panel for use in supporting loads recited in claim 5 wherein said second panel includes integral vertical side walls about its periphery, said side walls rising vertically upward and terminating in an outwardly flanged end, said flanged end adapted to contact and support said first panel about the periphery of said first panel.

7. The floor panel for sue in supporting loads recited in claim 1 further including a longitudinal trim member, said member having a beveled corner along the length of an outward edge, said longitudinal trim member adapted to fasten to the periphery of said floor panel whereby said beveled corner is adapted to extend beyond the periphery of said first and second panels, thereby contacting at the extremity of its extension the beveled corner of a neighboring panel, said beveled corner keeping neighboring panels slightly separated, thereby facilitating their removal and installation.

8. A floor panel for use in raised flooring systems of the type having a plurality of floor panels abutted against each other and supported by pedestals, comprising:

a first, substantially flat, rectangular panel;

a second panel having a plurality of generally hemispherical domes formed therein, each said dome having a flattened pole in contact with and attached to said first rectangular panel, each said pole adapted to transfer said load from said first panel to said second panel; and wherein said panel has a plurality of holes spaced about its periphery and wherein said panel further includes a resilient trim member having an arched longitudinal body and a plurality of staking projections integral to and extending from said arched body, each projection adapted to be received within a respective panel hole upon the deforming of said arched body, whereby upon the release of a deforming force upon said arched body, said body urges said staking projections against the side walls of said panel holes whereby said urging keeps said trim member in place during the manufacture of said panel, and wherein said longitudinal trim member further includes a beveled corner along the length of an outward edge, said beveled corner adapted to extend beyond the periphery of said first and second panels, thereby contacting at the extremity of its extension beveled corner of a neighboring panel, said beveled corner acting to minimize contact between neighboring panels, thereby facilitating their removal and installation.

9. The floor panel for use in supporting loads recited in claim 8 wherein said second panel includes integral vertical side walls about its periphery, said side walls rising vertically upward and terminating in an outwardly flanged end, said flanged end adapted to contact and support said first panel about the periphery of said first panel.

10. The floor panel for use in supporting loads recited in claim 8 wherein said domes are spaced apart and said second panel includes U-shaped channels formed in said second panel in said spaces between said domes.

11. An elevated floor system of the type having a plurality of substantially identical structural rectangular panels supported at their corners, comprising:

a rectangular panel having a substantially flat top surface and a bottom surface having a plurality of spaced apart hemispherical depressions, said bottom surface having a plurality of strengthening ridges residing in said spaces between said spaced apart hemispherical depressions, said panel having substantially vertical side wall extending between said top surface and said bottom surface, said side walls terminating in an outwardly extending flange, said flange surrounding the perimeter of said panel and provided with a plurality of holes, said flange including a trim member having a plurality of staking projections, each one of said projections respectively associated with a flange hole, said holes adapted to receive said staking projection, said trim member having a length and a beveled corner along an outward edge having an extremity of extension, said beveled corner adapted to extend beyond the periphery of said flange, thereby contacting the beveled corner of a neighboring panel at the extremity of its extension, said beveled corner acting to maintain sufficient space between neighboring panels, thereby facilitating their easy removal and installation.

* * * * *